United States Patent [19]

Krause

[11] Patent Number: 4,947,960

[45] Date of Patent: Aug. 14, 1990

[54] CONNECTING ELEMENT

[75] Inventor: Guenther Krause, Alsfeld, Fed. Rep. of Germany

[73] Assignee: Krause-Werk GmbH & Co. KG, Alsfeld, Fed. Rep. of Germany

[21] Appl. No.: 400,556

[22] Filed: Aug. 30, 1989

[30] Foreign Application Priority Data

Sep. 1, 1988 [DE] Fed. Rep. of Germany ... 8811069[U]

[51] Int. Cl.[5] ..... E06C 1/32; E06C 7/50

[52] U.S. Cl. ..... 182/26; 182/165

[58] Field of Search ..... 182/26, 22, 165, 166, 182/168

[56] References Cited

U.S. PATENT DOCUMENTS

| | | | |
|---|---|---|---|
| 766,246 | 8/1904 | Hartzler | 182/22 |
| 2,223,911 | 12/1940 | Garnette . | |
| 2,873,903 | 2/1959 | Osovski | 182/26 |

FOREIGN PATENT DOCUMENTS

| | | | |
|---|---|---|---|
| 2643118 | 4/1977 | Fed. Rep. of Germany | 182/26 |
| 1166010 | 11/1958 | France . | |
| 1372452 | 8/1964 | France . | |
| 2150013 | 3/1973 | France . | |
| 2391349 | 1/1979 | France | 182/26 |
| 529449 | 6/1955 | Italy | 182/26 |

*Primary Examiner*—Reinaldo P. Machado

*Attorney, Agent, or Firm*—Flynn, Thiel, Boutell & Tanis

[57] ABSTRACT

It has been necessary up to now for connecting two ladder elements in order to construct a free-standing ladder to connect the lower ends of the ladder elements by means of a tie rod. Furthermore a reliable connection only in the area of the upper ends of the ladder elements is not possible because of the danger of damaging the sidepieces. These disadvantages are supposed to be avoided with the invention. The invention provides, that the clamping elements of a connecting element fastened on a first sidepiece are constructed like a flat contact plate inclined with respect to the longitudinal axis of the first sidepiece and connected to the connecting element and like a swivel plate pivotal about an axis arranged perpendicularly with respect to the longitudinal axis of the first sidepiece. The connecting element of the invention can be used in all types of multi-purpose ladders.

12 Claims, 2 Drawing Sheets

CONNECTING ELEMENT

FIELD OF THE INVENTION

The invention relates to a connecting element for connecting first and a second ladder elements, with the connecting element being fastened to a first sidepiece of a first ladder element and including clamping elements for a second sidepiece of a second ladder.

BACKGROUND OF THE INVENTION

Ladders are known, which have a first and a second ladder element, which are each constructed like straight ladders with two sidepieces and a corresponding number of crosspieces. The two ladder elements can usually be connected at their upper end areas in order to construct a self-standing ladder like a free-standing ladder. In order to guarantee a secure stand of the ladder, it is necessary to not only connect the upper end areas of the ladder elements in a suitable manner, but to take care, that the lower end areas, which are set on the ground, do not move away from one another under stress, which would result in a collapse of the free-standing ladder.

In order to prevent an unfolding or moving apart of the lower ends of the two ladder elements, it is prescribed for safety technical reasons, in particular in the case of ladder elements, which are connected by a hinge in their upper area, that the lower areas of the ladder elements are connected by means of a tie rod limiting the maximum spreading of the ladder elements. The use of a tie rod is disadvantageous particularly for multipurpose ladders, in which the ladder elements can also be used in a different arrangement with one another, since the tie rod must be installed by the operator when using the ladder elements in the form of a free-standing ladder. The danger exists at all times, that this safety measure will be forgotten.

The upper areas of the ladder elements are clamped together in a known connecting element for connecting two ladder elements. Said clamping, however, cannot prevent a further angular spreading of the ladder elements in the known connecting elements, because said ladder elements are usually manufactured of aluminum profiles with a thin cross section and because forces can occur in the known connecting elements, which forces can result in a destruction or damage of the aluminum profiles. It is therefore necessary for safety reasons also in these embodiments to use a tie rod. The tie rod is also disadvantageous, because in particular a moving of the two ladder elements with respect to one another, as is desirous for other uses, is not possible, since the tie rod either limits the path of movement or must be released by the operator resulting again in the already described safety problems.

The basic purpose of the invention is to produce a connecting element of the above-mentioned type, which with a simple design and safe handling permits a connection of two ladder elements such, that a tie rod is not needed and the relative mobility of the two ladder elements with respect to other variations in arrangement is not hindered.

SUMMARY OF THE INVENTION

The purpose is attained inventively by the clamping elements being constructed like a flat contact plate inclined with respect to the longitudinal axis of the first sidepiece and connected to the connecting element and a swivel plate pivotal about an axis arranged perpendicularly with respect to the longitudinal axis of the first sidepiece.

The inventive connecting element is distinguished by a number of significant advantages. By using a contact plate and a swivel plate, it is possible to create a large bearing surface for the second sidepiece, so that damage to the second sidepiece, in particular through bearing on an edge of the connecting element, can be avoided. It is possible with the invention through the contact plate and the swivel plate to maintain the second sidepiece in frictional contact, with the frictional force being increased during stress on a free-standing ladder formed by the two ladder elements, so that a further angular spreading of the two ladder elements is not possible. Since according to the invention the connecting element is mounted fixedly on the first sidepiece of the first ladder element, it is possible in a particularly simple manner to connect the two ladder elements in order to construct a free-standing ladder.

Since the contact plate is according to the invention inclined at an angle with respect to the longitudinal axis, it is in this manner particularly easy to determine the angle formed between the two ladder elements when forming the free-standing ladder.

A jamming of the second sidepiece relative to the connecting element is not possible because of the pivotal arrangement of the swivel plate. The swivel plate can at all times rest completely on the corresponding surface of the sidepiece.

The contact plate and the swivel plate are in a favorable further development of the invention mounted on a bearing plate secured on the first sidepiece. The bearing plate can be fastened either removably on the first sidepiece, or it can be connected in a nonreleasable manner to said first sidepiece. The utilization of an additional bearing plate makes it possible to create a sufficient space for arranging the first sidepiece or rather for introducing the first sidepiece between the contact plate and the swivel plate.

In order to prevent, that the sidepiece slips off from the bearing plate or from the swivel plate under unfavorable load conditions, a further advantageous development of the invention provides, that the swivel plate, for gripping around the second sidepiece, on the side not facing the bearing plate is provided with a first support leg extending parallel with respect to said bearing plate. The second sidepiece is in this development embraced from three sides, namely from the bearing plate, the swivel plate and the support leg. The two ladder elements are connected such, that also lateral movements of the free-standing ladder or a lateral wobbling can be effectively prevented.

It can furthermore be advantageous for a safe guiding and mounting of the second sidepiece, that the swivel plate has a width equalling the width of the second sidepiece. A certain clamping of the second sidepiece can occur through this measure permitting a shifting or a carrying of the free-standing ladder formed by the two ladder elements without that said ladder collapses.

It can furthermore be advantageous, when the swivel plate is supported on the bearing plate above its center of gravity on the side not facing the contact plate by means of a bearing block. The support of the swivel plate does not influence its clamping action in this embodiment, since the bearing block is arranged on the backside of the swivel plate. The support above the center of gravity of the swivel plate achieves, that at a vertical arrangement of the first ladder element the swivel plate is arranged substantially parallel with respect to the longitudinal axis of the first sidepiece, so that an introduction or movement of the second sidepiece can be carried out without the danger of unintended clamping actions occurring.

The contact plate can include a second support leg extending parallel with respect to the bearing plate and in direction of the swivel plate, which second support leg, just like the first support leg, can be used to embrace the second sidepiece in order to prevent a lateral wobbling of the free-standing ladder. It can thereby be furthermore advantageous, when a groove-like recess to receive a crosspiece of the second ladder element exists in the second support leg. This recess permits a form-locking engagement of the crosspiece, so that an additional anchoring of the second ladder element is created. This measure significantly increases the operating safety.

Since the crosspieces are usually introduced with a spreading into the recesses of the sidepieces, it can be advantageous, when the contact plate has a width between the bearing plate and the second support leg, which width is greater than the width of the second sidepiece, since on the one hand the groove-like recess in the second support leg is exactly adapted to the dimensions of the crosspiece and since on the other hand an unintended jamming caused by the spreading of the crosspieces is prevented. Thus not the sidepiece, but the spreading of the crosspieces rest in this embodiment flat on the second support leg.

Furthermore it can be advantageous to arrange the axis of the swivel plate at the lower end area of the bearing plate and to construct the contact plate such, that same ends at the lower end area of the bearing plate. This development significantly eases the introduction of the second sidepiece into the connecting element and creates the possibility to carry out the frictional clamping such, that, in spite of the small dimensions of the connecting element, relatively large lever arms exist.

In order to ease the introduction of the second sidepiece and in order to prevent a jamming during a parallel movement of the two ladder elements, the lower end of the contact plate can be rounded.

The bearing plate is preferably provided with two holding plates, which are parallel to one another, and which extend on the side of the bearing plate, which side does not face the contact plate and the swivel plate, so that a U-shaped cross section is formed by the holding plates and the bearing plate, which cross section can form-lockingly embrace the first sidepiece. The fastening of the bearing plate and thus the connecting element on the first sidepiece can with this measure be significantly simplified and strengthened.

To assure a safe association of the first and of the second ladder element, it is advantageous if a connecting element is arranged on each sidepiece of the first ladder element. The connecting elements are thereby preferably constructed mirror-inverted, so that it is possible to construct the first ladder element wider than the second ladder element.

The connecting element creates inventively the possibility to connect the first ladder element and the second ladder element steplessly with one another to construct a free-standing ladder, it is particularly possible to construct the free-standing ladder in such a manner, that same can also be set up on steps or landings or also on sloping land.

BRIEF DESCRIPTION OF THE DRAWINGS

The invention is hereinafter described in connection with one exemplary embodiment and the drawings, in which.

DETAILED DESCRIPTION

Figure 1:
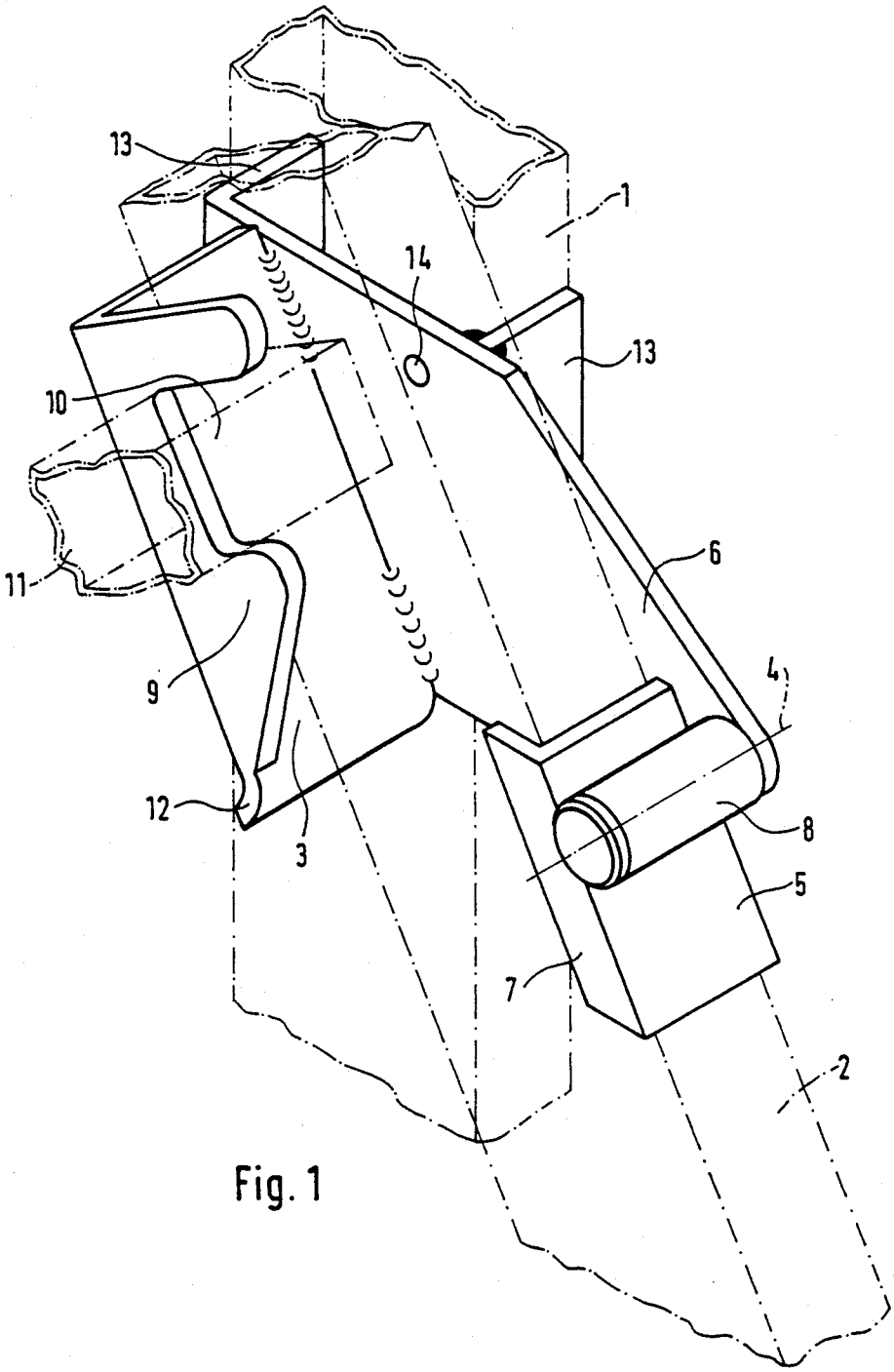
FIG. 1 is a perspective illustration of one exemplary embodiment of the inventive connecting element and of parts of associated ladder elements.
Figure 2:
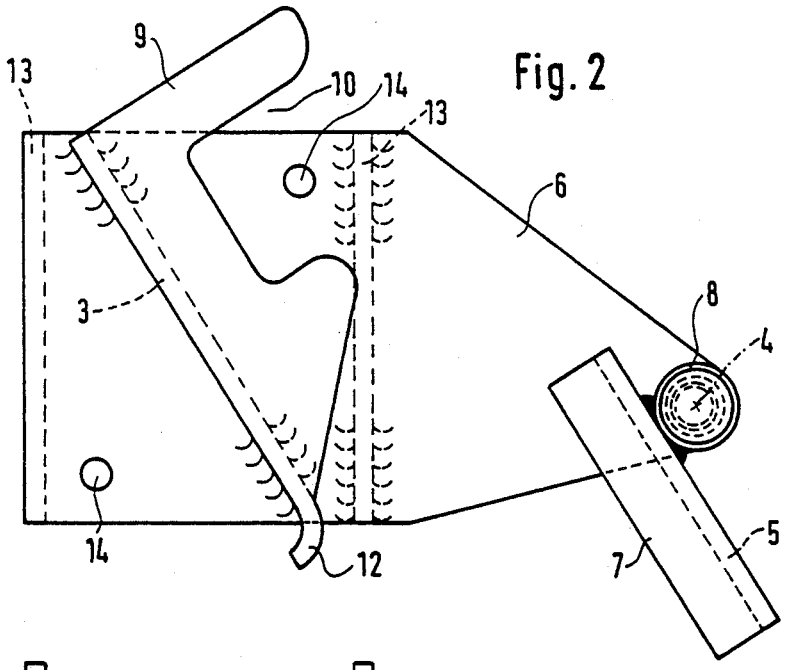
FIG. 2 is a side view of the connecting element shown in FIG. 1.
Figure 3:
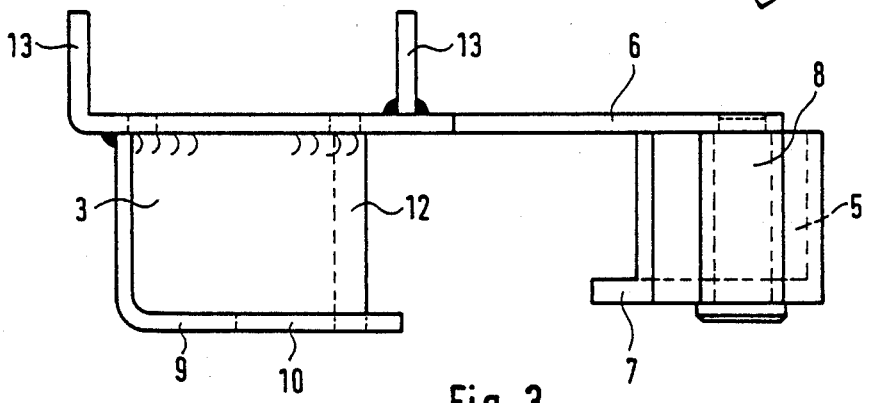
FIG. 3 is a top view of the connecting element shown in FIG. 2.

The connecting element shown in FIGS. 1 to 3 has a bearing plate 6, on which a substantially flat contact plate 3 is secured, for example by means of a welding connection.

Two parallel holding plates 13 are constructed on the bearing plate 6 on the side not facing the contact plate 3, for example by bending an end area of the bearing plate 6 and by welding on a separate element. The two holding plates 13 are spaced from one another at such a distance, that a first sidepiece 1 of a first ladder element, not illustrated in detail in the drawings, can be introduced into the U-shaped cross section constructed by the bearing plate 6 and the two holding plates 13.

The contact plate 3 is, as can particularly be seen in FIGS. 1 and 2, inclined at an angle with respect to the longitudinal axis of the first sidepiece, with the angle of inclination corresponding with the angle defined by the first sidepiece 1 and a second sidepiece 2 of a second ladder element, not illustrated in detail, when these two ladder elements form a free-standing ladder.

The bearing plate 6 illustrated in FIGS. 1 to 3 has a free end area, on which a swivel plate 5 is supported pivotally about an axis 4 arranged perpendicularly with respect to the longitudinal axis of the first sidepiece. The swivel plate 5 has a bearing block 8 secured above the center of gravity of said swivel plate 5 on said swivel plate. This off-center support has the result, that, as shown in FIG. 2, the swivel plate 5 in a not loaded state when the first sidepiece is arranged vertically assumes a position, in which said sidepiece is substantially parallel either with respect to the contact plate 3 or with respect to the longitudinal axis of the first sidepiece 1. This arrangement facilitates guiding in the second sidepiece 2.

The swivel plate 5 has furthermore a first support leg 7 extending substantially parallel with respect to the bearing plate 6. The swivel plate 5 and the first support leg 7 thus form a rectangular cross section. The space formed between the bearing plate 6 and the first support leg 7 is dimensioned such, that it equals the width of the second sidepiece 2, so that the second sidepiece 2 can be maintained in a stable manner relative to the first sidepiece.

At the free end of the contact plate 3, said contact plate is connected to a second support leg 9 also extending substantially parallel with respect to the bearing plate 6. Also the second support leg 9 is used for a better mounting of the second sidepiece 2 of the second ladder element.

The second support leg 9 has, as particularly shown in FIGS. 1 and 2, a recess 10, which is constructed groove-like and is dimensioned such, that said recess is adjusted to the dimensions of a crosspiece 11 connected to the second sidepiece 2. The possibility to introduce the crosspiece 11 into the recess 10 achieves an additional safety or locking of the second sidepiece 2.

The contact plate 3 can be rounded at its lower end 12 to facilitate a moving in of the second sidepiece 2 or rather a shifting of the second sidepiece 2 relative to the first sidepiece 1.

The bearing plate 6 furthermore can have recesses 14, through which screws or rivets can be guided, by means of which the bearing plate 6 can be secured on the first sidepiece 1.

FIG. 1 shows the inventive connecting element in a state ready for operation. The bearing plate 6 is thereby connected to the first sidepiece 1 through rivets guided through the recesses 14 and not illustrated in detail. The two holding plates 13 rest thereby on the first sidepiece 1. The second sidepiece 2 of the second ladder element is moved between the contact plate 3 and the swivel plate 5 and is thereafter pivoted such, that it rests with frictional contact on the surface of the contact plate 3 and of the swivel plate 5. In addition, the crosspiece 11 is guided into the recess 10 of the second support leg 9 in order to affect an additional locking. When the second sidepiece 2 is supposed to be arranged on the first sidepiece 1 in such a manner, that no crosspiece 11 exists in the area of the recess 10, then a safe clamping takes place through the friction between the contact plate 3 and the swivel plate 5.

The first ladder element is constructed wider in the illustrated exemplary embodiment than the second ladder element 2, so that the latter with its sidepieces can be moved or shifted in the area between the sidepieces of the first ladder element. In order to guarantee a stable support of the two ladder elements on one another, a connecting element is arranged on each sidepiece of the first ladder element, with the two connecting elements being designed as mirror images of one another.

The invention is not limited to the illustrated exemplary embodiment, rather many possibilities for modifications exist within the scope of the invention for the man skilled in the art.

The embodiments of the invention in which an exclusive property or privilege is claimed are defined as follows:

1. A connecting element for connecting first and second ladder elements, with the connecting element being fastened to a first sidepiece of the first ladder element and including clamping elements for a second sidepiece of the second ladder element, the clamping elements being constructed like a flat contact plate inclined with respect to the longitudinal axis of the first sidepiece and like a swivel plate pivotal about an axis arranged perpendicularly with respect to the longitudinal axis of the first sidepiece, the contact plate and the swivel plate being mounted on a bearing plate fastened on the first sidepiece.

2. A connecting element according to claim 1, wherein the swivel plate has for gripping around the second sidepiece on the side not facing the bearing plate a first support leg extending parallel with respect to the bearing plate.

3. A connecting element according to claim 1, wherein the swivel plate has a width equaling the width of the second sidepiece.

4. A connecting element according to claim 1, wherein the swivel plate is supported on the bearing plate on the side not facing the contact plate above its center of gravity by means of a bearing block.

5. A connecting element according to claim 1, wherein the contact plate includes a support leg extending parallel with respect to the bearing plate and in direction of the swivel plate.

6. A connecting element according to claim 5, wherein the contact plate has a width between the bearing plate and the support leg, which width is greater than the width of the second sidepiece.

7. A connecting element according to claim 5, wherein the support leg is provided with a groove-like recess for receiving a crosspiece of the second ladder element.

8. A connecting element according to claim 1, wherein the axis of the swivel plate is arranged at the lower end area of the bearing plate, and wherein the contact plate ends at the lower end area of said bearing plate.

9. A connecting element according to claim 8, wherein the lower end of the contact plate is rounded.

10. A connecting element according to claim 1, wherein on the side of the bearing plate, which side does not face the contact plate and the swivel plate, there are arranged two parallel holding plates constructing a U-shaped cross section with the bearing plate.

11. A connecting element according to claim 1, wherein a connecting element is arranged on each sidepiece of the first ladder element.

12. A connecting element according to claim 11, wherein the connecting elements are constructed mirror inverted relative to one another.

* * * * *